US006704389B1

(12) United States Patent
Bievenue et al.

(10) Patent No.: US 6,704,389 B1
(45) Date of Patent: Mar. 9, 2004

(54) SUPPORT DEVICE FOR A POLYCAPILLARY OPTIC

(75) Inventors: Thomas J. Bievenue, Delmar, NY (US); John H. Burdett, Porter Corners, NY (US)

(73) Assignee: X-Ray Optical Systems, Inc., East Greenbush, NY (US)

( * ) Notice: Subject to any disclaimer, the term of this patent is extended or adjusted under 35 U.S.C. 154(b) by 0 days.

(21) Appl. No.: 09/356,211

(22) Filed: Jul. 16, 1999

(51) Int. Cl.[7] ..... G21K 1/06
(52) U.S. Cl. ..... 378/84
(58) Field of Search ..... 378/84, 85

(56) References Cited

U.S. PATENT DOCUMENTS 5,192,869 A 3/1993 Kumakhov ..... 250/505.1
5,923,803 A 7/1999 Bunin et al. ..... 385/80
5,923,804 A 7/1999 Rosson ..... 385/81

*Primary Examiner*—Craig E. Church
(74) *Attorney, Agent, or Firm*—Heslin Rothenberg Farley & Mesiti P.C.; Kevin P. Radigan, Esq.

(57) ABSTRACT

A unitary support device for a polycapillary optic is provided wherein a housing has a central opening therethrough and at least two locating structures, such as positioning shoulders, formed therein. Each locating structure is sized and positioned to accommodate a different polycapillary positioning component within the housing. Each polycapillary positioning component has at least one opening for holding at least one polycapillary of the polycapillary optic. One or more coaxial bores can define the central opening of the housing and the locating shoulders in one continuous fabrication operation. Depending upon the polycapillary positioning components employed, i.e., location of the openings therein for accommodating the polycapillaries, the positioning components can be oriented within the housing such that radiation from one of a divergent beam, a focused beam, or a parallel beam is collected by the optic, and such that the optic can output one of a collimated beam, a focused beam or a divergent beam.

22 Claims, 3 Drawing Sheets

SUPPORT DEVICE FOR A POLYCAPILLARY OPTIC

FIELD OF THE INVENTION

This invention pertains generally to the field of x-ray and neutron multi-fiber polycapillary optics, and more particularly, to a novel support structure for a polycapillary optic.

BACKGROUND OF THE INVENTION

Conventionally, multi-fiber polycapillary optics are constructed by positioning screens (containing precise hole patterns) each onto a separate stiff screen holder. These constructions are then used to position glass fibers in space as described in U.S. Pat. No. 5,192,869. As seen in FIG. 1, a screen 18 is located relative to a screen holder 14 by pressing two locating pins therebetween. The screens have two holes 10 that align with the pins in the screen holder. The screen holders are then assembled together using precision rods 12 to locate each screen holder relative to the other in an x,y coordinate system. Positioning in the z direction is achieved by using spacers 16 between each screen holder. Up to four separate types of rods are thus used to precisely position the screen holders of the assembly.

A drawback of the above-summarized structure is that systematic errors associated with assembly of the screens to the screen holders may occur, as well as the screen holders to each other and to other components in the chain. As an example, the optic assembly of FIG. 1 uses four screens directly mounted to four screen holders, and separated by three independent pairs of spacers. Tolerance stack-ups associated with the mounting of the screens to frames and subsequent alignment of the system can result in large, uncontrollable tolerance errors. Thus, the resultant optic is susceptible to mis-alignment due to the inefficient way that the housing assembly is fastened together.

Further, it should be noted that the above-described approach employs screen holders which are aligned by two axes, i.e., by rods 12. Alignment using two axes results in five degrees of freedom (i.e., three translation, and two rotation) that can result in misalignment of the screen holders relative to each other. Additionally, there are four items that require tight tolerance control for each screen and screen holder combination. These include the holes in the screen holders for the rods and the two holes in each of the screen and screen holder for the locating pins.

Based upon the above, there exists a need in the art for an improved support device for a polycapillary optic.

SUMMARY OF THE INVENTION

Briefly summarized, presented herein is a novel support device for a polycapillary optic. The support device includes a housing having a central opening passing therethrough with at least two locating structures formed within the housing adjacent to the central opening and aligned about an axis of the central opening. Each locating structure is sized and positioned to accommodate a polycapillary positioning component within the housing. The at least two locating structures are formed such that the polycapillary positioning components can be oriented transverse to an axis of the central opening. The at least two polycapillary positioning components are designed to hold one or more polycapillaries of the polycapillary optic such that radiation from one of a divergent beam, a focused beam, or a parallel beam can be collected by the optic, and such that the optic can output one of a collimated beam, a focused beam or a divergent beam depending upon the configuration of openings in the polycapillary positioning components, as well as the positioning and orientation of the components within the housing.

Those skilled in the art will note from the following description that a support device and polycapillary optic assembly in accordance with this invention provide numerous advantages over the polycapillary positioning art, including: providing-higher repeatability of optic quality; being easier to assemble, and therefore less expensive to produce; having fewer components and a smaller total size, i.e., of the assembled x-ray optic package; elimination of positioning and assembly errors; ruling the assembly out as the problem if the resultant optic exhibits poor performance; reducing any possibility of components becoming loose, and the resulting misalignment of polycapillaries; facilitating use of the housing to align the resultant optic to a source, detector or sample; providing a greater ability to control tip, tilt and translation of the optic relative to a source, detector or sample; providing better control of rotation of screens relative to each other; reducing error associated with assembly and tolerance stack up; using a precise bore defining the inner opening as a means to accurately position the polycapillary optic relative to a radiation source or output location; and, in general, producing higher quality optics by improving radiation beam uniformity, focal spot and beam divergence characteristics.

BRIEF DESCRIPTION OF THE DRAWINGS

The above-described objects, advantages and features of the present invention, as well as others, will be more readily understood from the following detailed description of certain preferred embodiments of the invention, when considered in conjunction with the accompanying drawings in which.

DETAILED DESCRIPTION OF THE INVENTION

It is desirable in x-ray and neutron optics to use polycapillary optics to collect a diverging or parallel x-ray or neutron beam and convert the beam into a converging, parallel or diverging beam. Multi-fiber polycapillary optics include one or more polycapillaries positioned so that along their length they have a required profile for this purpose.

Figure 1:
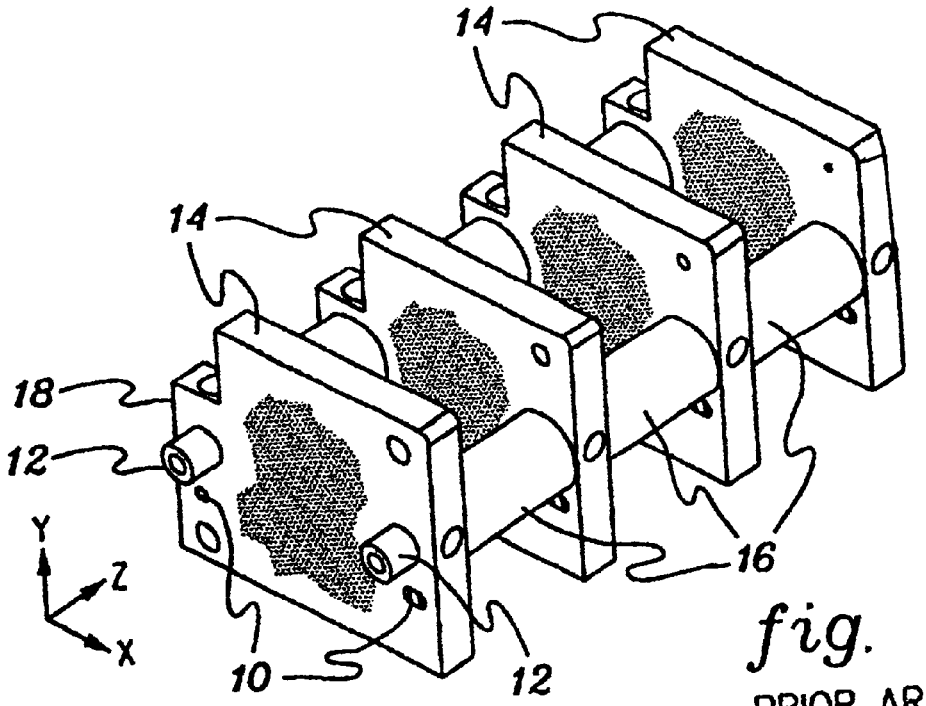
fig. 1 PRIOR ART
FIG. 1 is a perspective view of one embodiment of a conventional polycapillary optic positioning device.
Figure 2:
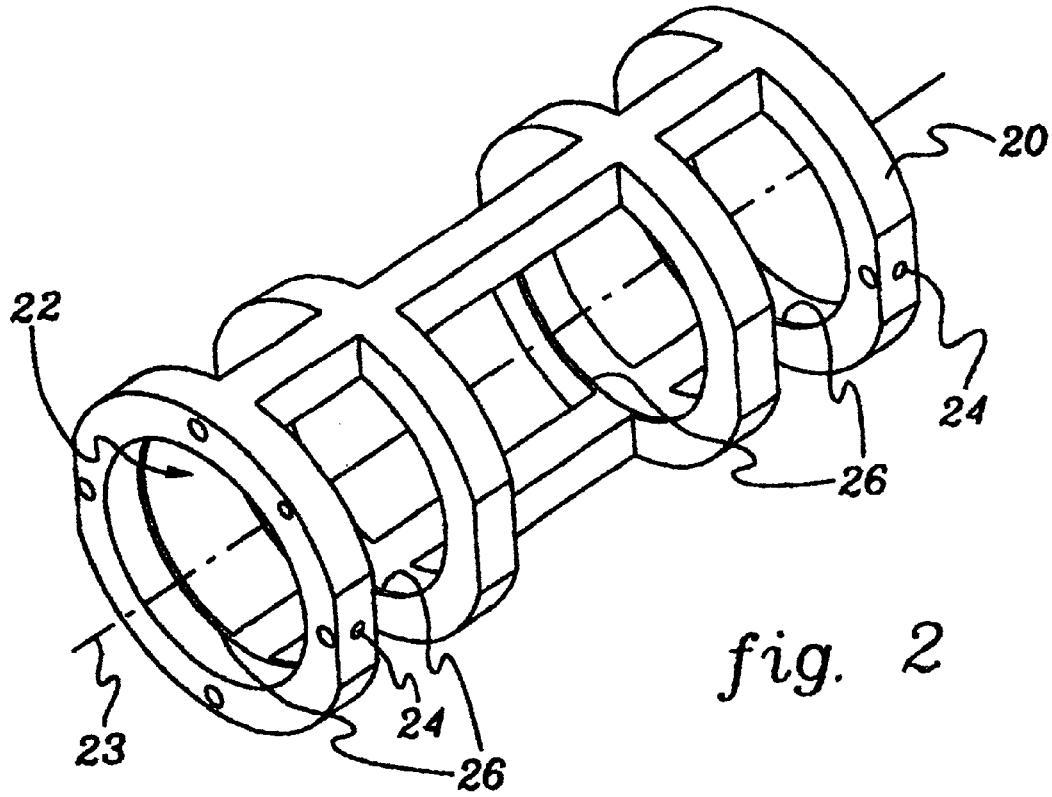
FIG. 2 is a perspective view of one embodiment of a support device for a polycapillary optic in accordance with the principles of the present invention.
Figure 3:
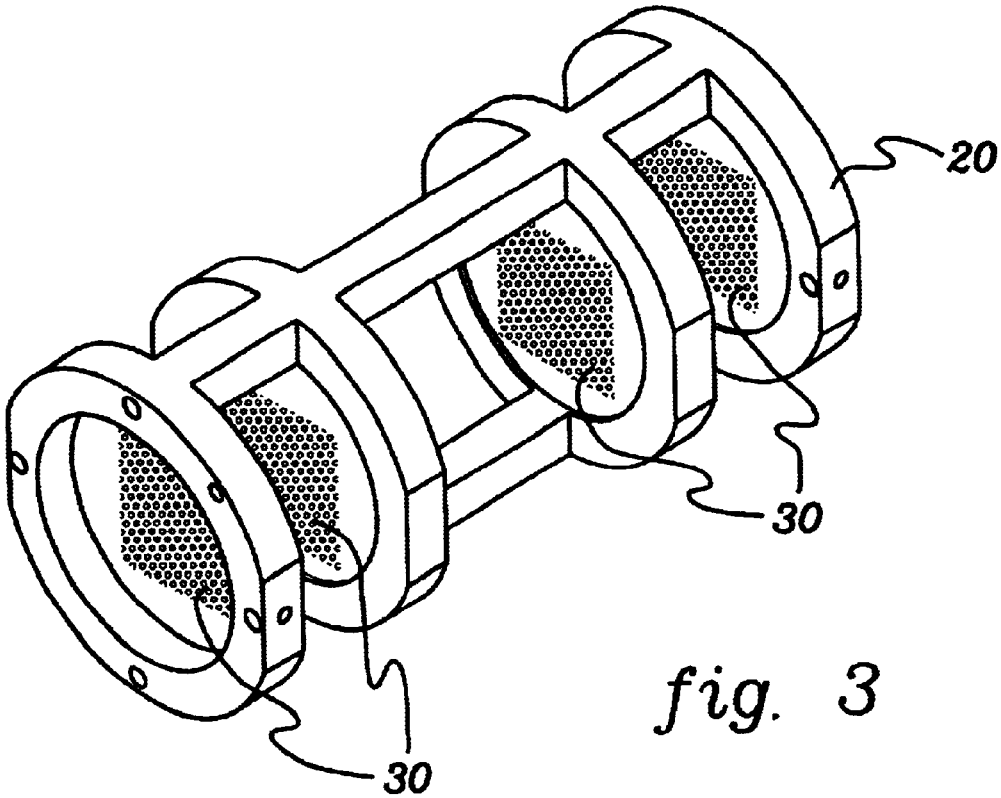
FIG. 3 is a perspective view of one embodiment of the support device of FIG. 2 with a plurality of polycapillary positioning components disposed therein.

A new design is presented herein for the manufacture of polycapillary optics. The design utilizes, in one embodiment, a one-piece support device 20 incorporating one or more internal bores that may have a constant or varying diameter so that a central opening or passageway 22 is defined as shown in FIG. 2. Within the inner surface of support device 20 defining the central opening, multiple locating structures 26 are defined for accommodating polycapillary positioning components as shown in FIG. 3. The central opening 22 has a central axis 23 that is used to align the positioning components. The use of a single axis 23 for alignment is significant because it eliminates the five degrees of freedom arising from the two-axes alignment approach described under the Background of the Invention. Also, many of the tolerance buildups are eliminated because the screens are aligned to the inside surface of support device 20 about the defining central axis 23, thereby eliminating tolerances associated with positioning holes 10 (FIG. 1) needed to align the screens to the screen holders and the holes for the rods 12 (FIG. 1) in the prior art approach.

In one embodiment, the locating structures may comprise shoulders formed on the inner surface of housing 20 at discrete positions along the axis of central opening 22 for facilitating placement of screens 30. Those skilled in the art will note that other locating structures could be employed in place of the shoulders depicted in FIG. 2. For example, discontinuous steps or lips could be provided, as well as channels formed circumferentially within the housing about the central opening. The support structure 20 may further include placement holes 24 for springs or other fastening means (not shown) on the side and/or on the bottom of the support structure to allow for positioning and alignment of the optic including translation and tilt.

FIG. 3 depicts one embodiment of positioning component 30. The positioning components, which typically comprise screens, are fabricated by photochemical machining, laser machining, electron discharge machining, or other fabrication process. Preferably, one or more polycapillary positioning holes 32 in the positioning components are fabricated at the same time, i.e., intrinsic to the nature of the process, thereby reducing positional errors. The screens are made using a fabrication process that decreases misalignment of the polycapillary positioning holes. As an example, photochemical machining, sometimes referred to as chemical milling or chemical etching, is a technique for manufacturing high-precision flat metal parts by chemically etching away the unwanted materials, using a photographically prepared mask to protect the metal that is to remain after the etching process.

For the positioning components described herein, a mask can be made where the hole positions for the polycapillaries are left exposed, a resist is placed on the metal and the mask protects the metal around the holes. The holes are chemically etched, leaving only the metal surrounding the holes. This approach allows the position of the inner (hexagonal) holes 36 to the exterior periphery 38 of the part to be tightly controlled. The assembly disclosed herein advantageously utilizes this tightly controlled tolerance from the interior hole positions to the exterior periphery of the positioning component as a means to control the fiber hole positions in the final assembly.

As shown in FIG. 3, unitary support device 20 accommodates positioning components 30 against locating structures 26 interfacing with internal opening 22. This design eliminates the stack-up errors that are inherent to the conventional polycapillary optic construction approach. Within the unitary structure 20, locating shoulders, steps, channels, openings, or other techniques could be used to locate the polycapillary positioning components of the assembly. Because these locating structures are precisely machined into the unitary frame, more exact placement of the polycapillary positioning components is achieved. In one specific example, the bore depth through housing 20 can be varied at predefined locations in order to create shoulders for receiving the positioning components and thereby control spacing along the optical axis between the different positioning components.

The outer shape of the support device 20 is non-critical relative to alignment of the polycapillary (glass) fibers. Hence the housing can be round, square or any other desired shape. Further, high precision tolerances are not critical to the outer profile. The more significant aspect is the inner bore configuration and depth that is used to create the locating structures to precisely locate the fiber positioning components.

Figure 5:
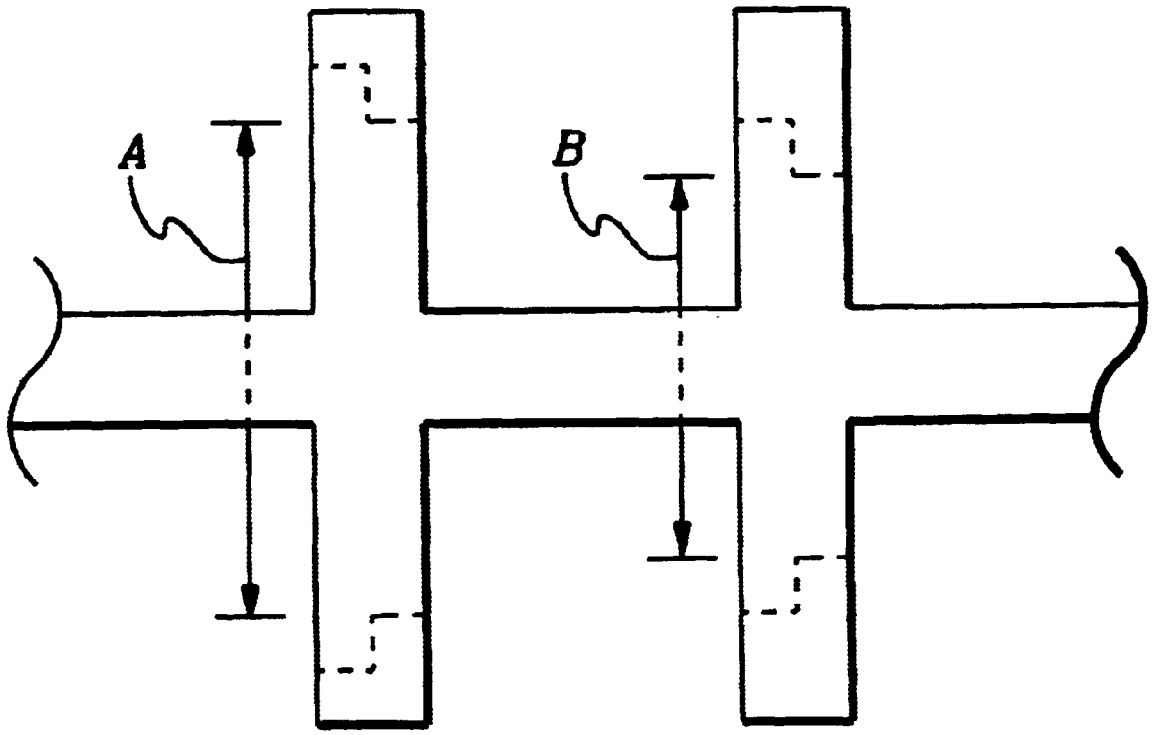
FIG. 5 is a breakaway, top view of the housing showing a varying diameter central opening.

As noted, the inner bore diameter of the housing can be used for locating the fiber positioning components relative to one another. For example, the bore depth can be varied as the central opening is being formed within the housing in order to create retaining steps at predefined positions within the housing. Further, in one embodiment, the diameter of the central opening could be adjusted to narrow with the formation of each retaining step within the housing (see FIG. 5 showing in cross-section two different diameters A, B of the central opening). Because the holes are bored into the mono-frame support structure, the stack-up error associated with a multiple part assembly is reduced. In the embodiment shown in FIGS. 2 & 3, the mono-frame support structure 20 uses a series of four coaxial bores 22 machined in one operation to establish the locating structures 26 for the polycapillary positioning components 30. A machining operation (such as boring or plunge electron discharge machining) yields a much tighter control on the positioning component alignment and the spacing between positioning components than the approach of FIG. 1. Although not shown, each screen of the positioning component could be supported by one or more disc supports that provide stiffness to the positioning component close to the edge of the fiber positioning holes.

In the depicted embodiment, four positioning components 30 are attached to support structure 20. The positioning components are supported by frames. Each frame/positioning component assembly is placed (and adhesively secured) into position at the appropriate location, i.e., at the appropriate locating structure. The positioning components may be placed into the support structure from the side or through the inner bore openings. Each positioning component is aligned relative to the first positioning component that is placed in the inner core to avoid rotation of the positioning components relative to one another.

Figure 4:
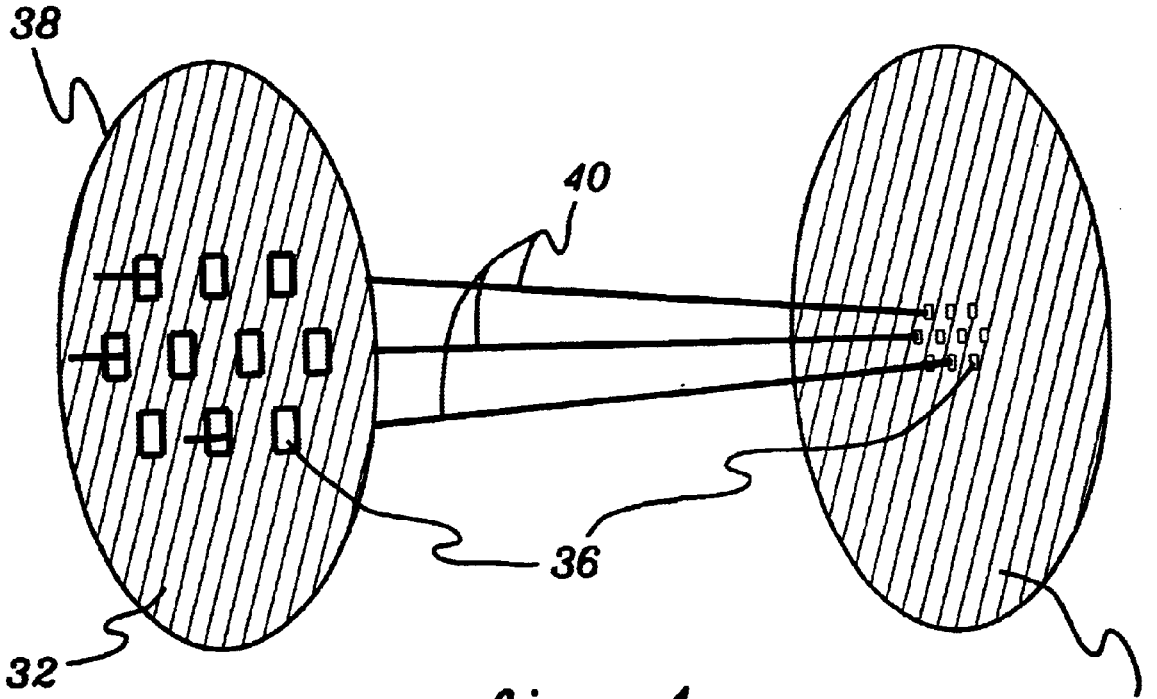
FIG. 4 is a perspective view of one embodiment of two screens which may be employed within the support device of FIG. 3 showing polycapillaries 40 passing therethrough and depicting an optic which is to receive uniform source radiation at the left and output a converging beam at the right.

FIG. 4 depicts an example of two different positioning components 32 & 34 for use within a polycapillary optic assembly in accordance with the principles of the present invention. In this example, the spacing between openings 36 in positioning components 32 & 34 is varied relative to the outer perimeter 38 of the screen. This arrangement might be used if the optic assembly is to collect a parallel beam at its input (left side) and convert it to a focused beam at its output (right side). Those skilled in the art will note that by varying the positioning components (30) within the housing, different polycapillary optics can be readily assembled. Specifically, polycapillary optics can be assembled for a parallel source, a diverging source, or a converging source, and similarly, optics can be assembled to produce a collimated, converging, or diverging beam.

For a polycapillary optic to accept diverging radiation and output converging radiation, the first and last locations of positioning components within the housing determine the input and output focal distances. Thus, the orientation of the polycapillary fibers at these positioning components is significant to fabrication of the optic with the desired input and/or output focal distance. Similarly, for an optic accepting parallel radiation, the location of the last positioning component is significant. For an optic accepting diverging radiation and outputting converging radiation, the location of the first positioning component is important.

Variables to be controlled might include internal bore diameters, the concentricity of the inner core frame, and the required tolerance level associated with the positioning component manufacture. For example, in one preferred embodiment, the positioning components can be manufactured at different tolerance levels for the location of the fiber positioning holes (32) relative to the outside circumference of the positioning component (30). An acceptable tolerance can range from 1 to 100 microns. Associated with the positioning component tolerance improvements are substantial cost considerations. The tolerance level of the boring operation, and manufacturing tolerances of the positioning components can be varied as needed in order to meet different performance criteria of the optic. Those skilled in the art will note that the support device and polycapillary optic assembly presented herein can be produced for a wide range of optic sizes, for example, for optics from a diameter of 500 $\mu$m to 1 meter, and with a length varying from 2 mm to 2 meters.

While the invention has been described in detail herein in accordance with certain preferred embodiments thereof, many modifications and changes therein may be effected by those skilled in the art. Accordingly, it is intended by the appended claims to cover all such modifications and changes as fall within the true spirit and scope of the invention.

What is claimed is:

1. A support device for a polycapillary optic, said support device comprising:

a unitary housing having a central opening passing therethrough, said central opening having an axis;

at least two locating structures formed within said housing adjacent to said central opening therethrough, wherein each locating structure is sized and positioned to accommodate a polycapillary positioning component within said housing, and wherein each locating structure is aligned about said axis; and wherein said at least two locating structures facilitate positioning of at least two polycapillary positioning components to be disposed within said housing for holding polycapillaries of said polycapillary optic.

2. A support device of claim 1, further comprising said at least two polycapillary positioning components, wherein said polycapillary positioning components, when disposed at said locating structures, orient said polycapillaries such that radiation from one of a divergent beam, a focused beam, or a parallel beam can be collected by said polycapillary optic, and such that said polycapillary optic can output one of a collimated beam, a focused beam or a divergent beam.

3. The support device of claim 2, wherein each polycapillary positioning component comprises a positioning screen having at least one opening therein for accommodating a polycapillary of said polycapillary optic.

4. The support device of claim 2, wherein each polycapillary positioning component comprises a positioning screen having multiple openings therein for accommodating multiple polycapillaries of said polycapillary optic.

5. The support device of claim 4, wherein said multiple openings of at least some of said at least two polycapillary positioning components are disposed differently within said respective polycapillary positioning components to facilitate orienting of said polycapillaries such that radiation from said one of a divergent beam, a focused beam, or a parallel beam can be collected, or to facilitate said polycapillary optic outputting said one of a collimated beam, a focused beam, or a divergent beam.

6. The support device of claim 1, wherein said at least two locating structures comprise at least two shoulders formed integral with an internal surface of said housing defining said central opening.

7. A support device for a polycapillary optic, said support device comprising:

a housing having a central opening passing therethrough, said central opening having an axis;

at least two locating structures formed within said housing adjacent to said central opening therethrough, wherein each locating structure is sized and positioned to accommodate a polycapillary positioning component within said housing, and wherein each locating structure is aligned about said axis; and wherein said at least two locating structures facilitate positioning of at least two polycapillary positioning components to be disposed within said housing for holding polycapillaries of said polycapillary optic;

wherein said housing comprises a unitary structure, and said at least two polycapillary positioning components comprise positioning screens each with at least one fiber positioning hole passing therethrough, each said at least one fiber positioning hole being located within said screen relative to a periphery thereof to a tolerance of less than 100 microns.

8. The support device of claim 7, wherein within at least one screen, location of said at least one fiber positioning hole determines whether an output of said polycapillary optic is converging, diverging, or parallel.

9. The support device of claim 1, wherein said housing comprises an open frame structure having said central opening passing therethrough, said open frame structure comprising multiple ring sections fixedly interconnected, each ring section having one locating structure of said at least two locating structures for facilitating positioning of a corresponding polycapillary positioning component within the support device.

10. The support device of claim 9, wherein said at least two locating structures each comprises a shoulder for facilitating positioning of one of said polycapillary positioning components, each shoulder being associated with one of said ring sections of said open frame.

11. The support device of claim 1, wherein said polycapillary optic comprises a lens for focusing x-ray or neutron radiation.

12. The support device of claim 1, wherein a diameter of said central opening varies along a length of said housing.

13. The support device of claim 1, wherein said housing further comprises placement holes for accommodating a fastener to allow for positioning and alignment of the support device relative to a source or an output focal point.

14. A polycapillary optic assembly comprising:

at least one polycapillary of said polycapillary optic;

a support device for said at least one polycapillary, said support device comprising:

a unitary housing having a central opening passing therethrough, said central opening having an axis;

at least two locating structures formed within said housing adjacent to said central opening therethrough, wherein each locating structure is sized and positioned to accommodate a polycapillary positioning component within said housing, and wherein each locating structure is aligned about said axis; and wherein said at least two locating structures facilitate positioning of at least two polycapillary positioning components to be disposed within said housing for holding said at least one polycapillary therein.

15. The polycapillary optic assembly of claim 14, further comprising said at least two polycapillary positioning components, wherein said polycapillary positioning components, when disposed at said locating structures, orient said at least one polycapillary such that radiation from one of a divergent beam, a focused beam, or a parallel beam can be collected by said polycapillary optic, and such that said polycapillary optic assembly can output one of a collimated beam, a focused beam or a divergent beam.

16. The polycapillary optic assembly of claim 15, wherein each polycapillary positioning component comprises a screen having at least one opening therein for accommodating a polycapillary of said polycapillary optic.

17. The polycapillary optic assembly of claim 16, wherein said at least one opening in each screen comprises multiple openings, and wherein said multiple openings of at least some of said at least two polycapillary positioning components are disposed differently within said respective polycapillary positioning components to change orientation of said polycapillaries between an input and an output of said polycapillary optic assembly.

18. A polycapillary optic assembly comprising:

at least one polycapillary of said polycapillary optic;

a support device for said at least one polycapillary, said support device comprising:

a housing having a central opening passing therethrough, said central opening having an axis;

at least two locating structures formed within said housing adjacent to said central opening therethrough, wherein each locating structure is sized and positioned to accommodate a polycapillary positioning component within said housing, and wherein each locating structure is aligned about said axis; and wherein said at least two locating structures facilitate positioning of at least two polycapillary positioning components to be disposed within said housing for holding said at least one polycapillary therein;

wherein said housing comprises a unitary structure, and wherein said at least two locating structures comprise at least two shoulders formed integral with an internal surface of said unitary housing.

19. The polycapillary optic assembly of claim 14, wherein said at least one polycapillary comprises a lens for focusing x-ray or neutron radiation.

20. A method for fabricating a support device for a polycapillary optic, said method comprising:

providing a housing and forming a central opening within said housing, said forming of said central opening comprising machining a central opening through said housing such that said central opening is defined by at least one coaxial bore, said central opening having an axis; and defining at least two locating structures within said housing adjacent to said central opening therethrough and aligned about said axis, wherein each locating structure is sized and positioned to accommodate a polycapillary positioning component within the housing, said polycapillary positioning components to be disposed within said housing for holding polycapillaries of said polycapillary optic.

21. The method of claim 20, further comprising positioning said at least two polycapillary positioning components within said housing using said at least two locating structures, wherein said polycapillary positioning components, when disposed at said locating structures, orient said polycapillaries such that radiation from one of a divergent beam, a focused beam, or a parallel beam can be collected by the polycapillary optic, and such that the polycapillary optic can output one of a collimated beam, a focused beam or a divergent beam.

22. The method of claim 20, further comprising boring said central opening such that said at least two locating structures comprise at least two shoulders defined on an inner surface of said housing surrounding said central opening.

* * * * *